US011952198B2

(12) United States Patent
Streiff et al.

(10) Patent No.: US 11,952,198 B2
(45) Date of Patent: Apr. 9, 2024

(54) PACKAGING FOR THE COOLED STORAGE OF AT LEAST ONE PRODUCT AND ASSOCIATED CONTAINER

(71) Applicant: RICHARD BRETSCHNEIDER GMBH, Braunschweig (DE)

(72) Inventors: Sven Holger Streiff, Braunschweig (DE); Maik Bermeitinger, Söhlde (DE)

(73) Assignee: RICHARD BRETSCHNEIDER GMBH, Braunschweig (DE)

( * ) Notice: Subject to any disclaimer, the term of this patent is extended or adjusted under 35 U.S.C. 154(b) by 77 days.

(21) Appl. No.: 17/274,614

(22) PCT Filed: Sep. 5, 2019

(86) PCT No.: PCT/EP2019/073763
§ 371 (c)(1),
(2) Date: Mar. 9, 2021

(87) PCT Pub. No.: WO2020/053073
PCT Pub. Date: Mar. 19, 2020

(65) Prior Publication Data

US 2022/0112021 A1 Apr. 14, 2022

(30) Foreign Application Priority Data

Sep. 11, 2018 (DE) ..... 10 2018 122 127.4

(51) Int. Cl.
*B65D 81/38* (2006.01)
*B65D 5/24* (2006.01)
(Continued)

(52) U.S. Cl.
CPC ..... *B65D 81/3855* (2013.01); *B65D 5/241* (2013.01); *B65D 5/40* (2013.01);
(Continued)

(58) Field of Classification Search
CPC ..... B65D 81/3855; B65D 5/241; B65D 5/40; B65D 81/18; B65D 43/163; B65D 43/164;
(Continued)

(56) References Cited

U.S. PATENT DOCUMENTS 2,728,200 A 12/1955 Lobl
4,328,923 A * 5/1982 Graser ..... B65D 5/0005 206/427
(Continued)

FOREIGN PATENT DOCUMENTS

DE 9410670 U1 8/1994
EP 0711964 A1 5/1996
(Continued)

OTHER PUBLICATIONS

Bonnie M. Dill, 65 Gallon Cooler Basket Accessory, 2017, Amazon.com, ASIN: B06XKMN7QB, Date First Available: Mar. 14, 2017 (Year: 2017).*
(Continued)

*Primary Examiner* — Anthony D Stashick
*Assistant Examiner* — Marcos Javier Rodriguez Molina
(74) *Attorney, Agent, or Firm* — WC&F IP

(57) ABSTRACT

The invention relates to packaging (10) for the cooled storage of at least one product (12), with (a) an outer casing (14) that comprises (i) a base (22) and (ii) at least three walls (24), (b) an inner compartment (16) for accommodating the product (12) and (c) a coolant compartment (18) that (i) surrounds the inner compartment (16) on at least three sides and (ii) is water-tight, wherein (d) the outer casing (14) surrounds the coolant compartment (18) and wherein (e) the outer casing (14) and the inner compartment (16) are designed in such a way that the coolant compartment (18) is water-tight and can be filled with water such that, after the
(Continued)

Figure 1B:
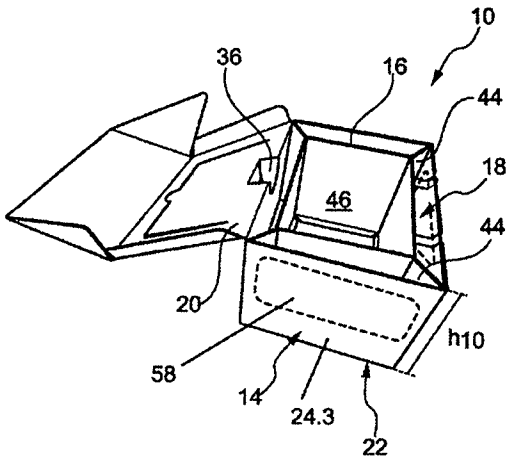

water freezes, the water cools the products (12) in the inner compartment (16).

18 Claims, 7 Drawing Sheets

(51) Int. Cl.

| | |
|---|---|
| ***B65D 5/40*** | (2006.01) |
| ***B65D 5/42*** | (2006.01) |
| ***B65D 5/50*** | (2006.01) |
| ***B65D 5/66*** | (2006.01) |
| ***B65D 81/18*** | (2006.01) |
| ***F25D 3/08*** | (2006.01) |
| *B65D 5/54* | (2006.01) |
| *B65D 5/70* | (2006.01) |

(52) U.S. Cl.
CPC ..... *B65D 5/4204* (2013.01); *B65D 5/5035* (2013.01); *B65D 5/6664* (2013.01); *B65D 81/18* (2013.01); *F25D 3/08* (2013.01); *F25D 2303/0831* (2013.01)

(58) Field of Classification Search
CPC ... B65D 43/16; F25D 3/08; F25D 2303/0831; F25D 3/02; F25D 3/00; F25D 2331/804; F25D 3/06; F25D 33/08; F25D 33/02; F25D 2303/083
USPC ..... 220/592.2, 592.09, 739, 592.03, 592.23, 220/592.24, 62, 371, 592.05, 592.15, 220/62.12, 495.03, 592.01, DIG. 9, 220/DIG. 30, 915.2, 915.1, 903, 902, 8, 220/780, 771, 755, 752, 751, 740, 737, 220/720, 713, 709, 676, 669, 666, 661, 220/630, 629, 62.22, 62.19, 62.18, 62.15, 220/62.13, 615, 6, 592.28, 592.27, 220/592.26, 592.25, 592.22, 592.21, 220/592.18, 592.17, 592.16, 592.14, 220/592.1, 592.02, 577, 575, 574.3, 220/574.2, 574.1, 569, 560.04, 560.02, 220/556, 524, 522, 501, 4.29, 4.28, 4.26, 220/4.24, 379, 345.1, 315, 288, 253, 231, 220/23.88, 23.87, 23.86, 23.83, 23.8, 220/23.6; 62/457.7, 457.1, 62, 530, 53.2, 62/52.1, 515, 457.2, 440, 374, 371, 352, 62/324.3; 53/428; 229/5.84, 5.83, 120, 229/115, 103.11, 100; 224/645, 625, 448, 224/435, 425, 414, 148.7, 148.5, 148.4, 224/148.3
See application file for complete search history.

(56) References Cited

U.S. PATENT DOCUMENTS

| | | | | | |
|---|---|---|---|---|---|
| 4,638,645 | A * | 1/1987 | Simila | F25D 31/007 | 62/529 |
| 5,094,359 | A * | 3/1992 | DeMars | B65D 5/0005 | 206/427 |
| 5,170,934 | A * | 12/1992 | Lemoine | B65D 81/18 | 229/101 |
| 5,303,863 | A * | 4/1994 | Arasim | B65D 81/36 | 229/101 |
| 5,337,911 | A * | 8/1994 | Holub | A45C 11/20 | 220/254.3 |
| 6,026,978 | A * | 2/2000 | Clegg | F25D 3/08 | 220/528 |
| 8,844,720 | B2 * | 9/2014 | Lantinen | B65D 85/60 | 206/457 |
| 2002/0112501 | A1 * | 8/2002 | Williams, Jr. | A45C 11/20 | 62/530 |
| 2003/0213263 | A1 * | 11/2003 | Woog | A45C 11/20 | 206/427 |
| 2008/0006642 | A1 | 1/2008 | Hidary | | |
| 2014/0263593 | A1 * | 9/2014 | Vasbinder | B65D 5/4608 | 229/117.23 |
| 2016/0341464 | A1 * | 11/2016 | Bagwell, Sr. | F25D 3/08 | |

FOREIGN PATENT DOCUMENTS

| | | | | |
|---|---|---|---|---|
| EP | 734674 | A1 * | 10/1996 | A47J 41/0072 |
| FR | 2303734 | A1 | 10/1976 | |
| WO | 1989/008061 | A1 | 9/1989 | |
| WO | WO-8908061 | A * | 9/1989 | F25D 3/06 |
| WO | WO-9611848 | A1 * | 4/1996 | B65D 5/0005 |

OTHER PUBLICATIONS

Bonnie M. Dill, 65 Gallon Cooler Basket Accessory, 2017, Amazon.com, ASIN: B06XKMN7QB, Date First Available: Mar. 14, 2017 (Year: 2017) (Year: 2017).*

AmazonDOTcom, Reviewer Bonnie M. Dill, RTIC 65 Gallon Cooler Basket Accessory, Sep. 26, 2017, ASIN: B06XKMN7QB (Year: 2017).*

"Requirements for the recovery of packaging through composting and biodegradation. Test scheme and evaluation criteria for packaging classification German version EN 13432:2000", foreword, 2000.

Correction to "Requirements for the recovery of packaging through composting and biodegradation. Test scheme and evaluation criteria for packaging classification German version EN 13432:2000", 2005.

DIN EN 13432, Berichtigung 2, "Packaging—Requirements for packaging recoverable through composting and biodegradation—Test scheme and evaluation criteria for the final acceptance of packaging", Oct. 2005.

DIN EN 13432, Anforderung, "Packaging—Requirements for packaging recoverable through composting and biodegradation—Test scheme and evaluation criteria for the final acceptance of packaging" German version EN 13432:2000, Dec. 2000.

* cited by examiner

PACKAGING FOR THE COOLED STORAGE OF AT LEAST ONE PRODUCT AND ASSOCIATED CONTAINER

The invention relates to packaging for the cooled storage of at least one product. Packaging serves to protect the product that is to be packaged against environmental influences, particularly contamination and excessive heat.

For some products, it is desirable for the packaging to keep the product at a temperature that is considerably lower than the ambient temperature. To this end, it is known practice to place bags of water ice or dry ice in the packaging to cool it. The disadvantage of known packaging is that it is relatively expensive or relatively difficult to produce.

U.S. Pat. No. 2,728,200 describes a cardboard packaging whose inner compartment is enclosed by a layer of air. Ice is held in a bag in an insert.

US 2008/0 006 642 A1 describes a double-walled container that is preferably made of plastic and in whose double wall a liquid can be provided. This liquid contains, for example, an anti-freeze agent.

The invention aims to propose improved packaging.

The invention solves the problem by way of packaging with the properties in claim 1, in particular packaging for the cooled storage of at least one product, with (a) an outer casing that comprises (i) a base, (ii) a lid and (iii) at least three walls that extend between the base and the lid, (b) an inner compartment for accommodating the product and (c) a coolant compartment that (i) surrounds the inner compartment on at least three sides and (ii) is water-tight, wherein (d) the outer casing surrounds the coolant compartment and wherein (e) the outer casing and the inner compartment are designed in such a way that the coolant compartment is water-tight and can be filled with water such that, after the water freezes, the water cools the products in the inner compartment.

The advantage of the invention is that the coolant, i.e. the frozen water in the present case, only has to be added just before the packaging is used. This has the advantage that it renders the shipment of the product, for example by post, considerably easier. On the one hand, the weight of the packaging is lower as it does not contain any water; on the other hand, there is no risk of the coolant escaping. In other words, it is possible for a container according to the invention consisting of the sales packaging with products contained therein, for example in an outer packaging, to be used to ship the product without refrigeration. The water is then filled and frozen by the customer, thereby cooling the product until it is used.

The invention therefore also includes a container with an outer packaging that surrounds the container. The invention also includes a method for sending a container according to the invention or a shipping unit consisting of a container according to the invention and an outer packaging.

The invention also solves the problem by way of a kit or set of sheets that are cut and folded in such a way that packaging according to the invention can be produced by folding them. With such a set of sheets, the user can quickly create packaging according to the invention.

The recipient can store the container without the coolant compartment being filled with water. Prior to using the packaging as a cool box, the inner compartment is filled with water. The resulting container, with the water in the inner compartment, is then frozen. This causes the water to freeze. However, the water does not come into contact with the products, so they do not freeze into a tight connection with the ice. The product is then surrounded by ice, so that the temperature of the product cannot rise significantly above 0°.

Within the scope of the present description, the outer casing should be understood to mean the part of the packaging that forms the boundary with an environment of the packaging. The outer casing is preferably prismatic, in particular cuboid in shape. It should be noted that a cube is a special case of the hexadron; the outer casing can be cube-shaped, for example. Other bases of the outer casing are also conceivable: for instance, it may be round. It is favourable if the base of the outer casing corresponds to a horizontal cross-section of the product.

The base should be understood to mean the part of the outer casing that is designed to be placed on a surface. The packaging has a removal device in which the products are to be removed from the packaging. The state in which the products can be removed from the packaging is when the packaging is standing on its base.

The lid should be understood to mean the part of the outer casing that lies opposite the base. The lid is preferably designed to be flexible, i.e. the lid can be brought into a closing position and an opening position. In the closing position, access to the product is prevented; in the opening position, access to the product is possible.

If there are three walls, the outer casing is preferably prismatic and can then preferably have a base of an equilateral or right-angled triangle, wherein the triangle can then have precisely two sides of equal length. If the outer casing is cuboid, there are four walls. Theoretically, it is also possible for the outer casing to be prismatic and have a hexagonal base, the base thus having the form of a regular hexagon. Such prisms can be densely packed. Other bases are possible.

The outer casing is water-tight, such that water cannot escape from the coolant compartment. The inner compartment is also water-tight, such that water also cannot leak from the coolant compartment and penetrate into the inner compartment.

The coolant compartment should be understood the area bounded by the outer casing and the inner compartment. The inner compartment can be formed of an inde-pendent component; however, this is not essential. The coolant compartment is usu-ally only bounded by the outer casing and the inner compartment.

The water is preferably accommodated directly in the coolant compartment. In other words, there is preferably no component that additionally surrounds the water. In other words again, the water is in contact with the inside of the outer casing and the outside of the inner compartment. For example, the water is poured into the inner compartment.

It is possible, but not essential, for the coolant compartment to consist of sub-com-partments. It is especially favourable if the coolant compartment can be completely filled with water by pouring water into it at one point.

According to a preferred embodiment, the outer casing is made of at least one, in particular exactly one, first sheet and produced by folding said sheet. Alternatively or additionally, the inner compartment is made of at least one, in particular exactly one, second sheet and produced by folding said sheet. The feature that the at least one sheet is made by folding it should be understood particularly to mean that the folding is a production step. It is possible, but not essential, for other production steps to be added, for example gluing different areas of the sheet. It is beneficial, albeit not essential, that the outer casing and/or the inner compartment are made from one sheet and produced solely by folding and possibly gluing it. In this case, the outer casing and/or inner compartment can be disassembled and disposed of especially easily.

It is favourable if at least one of the at least one first sheet is made of a cellulose product, in particular a laminated cellulose product. A cellulose product should be understood to mean a product that consists predominantly, in particular to at least 90% by weight, of paper, cardboard or paperboard. Paperboard may be corrugated paperboard, but this is not essential. The cellulose product is preferably compostable and water-tight. The optional lamination renders the cellulose product water-tight.

Alternatively or additionally, at least one of the at least one second cardboard is made of a cellulose product, in particular a laminated cellulose product. The optional lamination is water-tight.

Lamination should be understood to mean, for example, a coating, in particular with a plastic film, that is applied, especially glued, to the cardboard. Laminated cardboard is easy to produce, to process and to recycle. It is especially beneficial if the lamination is made of biodegradable and/or compostable plastic. It is especially beneficial if the entire packaging is made at least 90% by weight of compostable material. In this case, an environmental impact is low even if the packaging is not disposed of properly. In principle, all biodegradable, water-tight materials and fibres can be considered.

As an alternative, the outer casing and/or the inner compartment can be made of plastic, especially compostable plastic. For example, the inner compartment may consist of a structured, for instance a thermoformed, plastic film. It is particularly favourable if the plastic is transparent, in particular colourless and transparent. The ice can then be seen from the outside, rendering the functionality of the packaging especially clear.

Within the scope of the present description, compostable plastic should be understood to mean a plastic that complies with EN13432 as of the filing date.

According to a preferred embodiment, the outer casing is designed in such a way that it can be removed after the coolant compartment has been filled with water and the water has been frozen. In particular, the side of the outer casing that faces the coolant compartment features a coating or lamination that adheres sufficiently little to ice. In particular, the coating or lamination is hydrophobic. The coating or lamination preferably features a contact angle of at least 95°, especially at least 100°, in relation to water. One option is lamination with polypropylene foil.

Packaging that features a negative relief on the side of the outer casing that faces the coolant compartment is especially preferable. This leads to the formation of a negative of the negative relief and therefore a positive on the ice. For example, the negative relief comprises a negative of a logo, such as the brand of the product.

It is particularly favourable if the negative relief is formed by embossing the outer casing. In this case, the embossing on the outside of the outer casing can be seen in the positive and also leaves a positive in the frozen water.

In this case, it is especially favourable if the inner compartment—as described above—is made of transparent plastic or can be easily separated from the ice and removed by way of appropriate labelling. After the removal of the inner and outer compartment, the product then appears to be enclosed in a block of ice.

Alternatively or additionally, the packaging comprises a label that is connected to the outer casing via a web and arranged in the coolant compartment. If the coolant compartment is filled with water, the label is kept at a distance from both the inside of the outer casing and the inner compartment by the water. If the water in the coolant compartment is frozen and the outer casing removed, the web tears and the label re-mains frozen in the ice.

According to a preferred embodiment, the outer casing has a filling opening that is arranged in such a way that water can be filled through the filling opening exclusively into the coolant compartment. In other words, the filling opening is arranged in such a way that by pouring water into the filling opening, for example by means of a jug or a tap, the water only reaches the coolant compartment and not the inner compartment.

Preferably, the filling opening is configured either entirely or partially in the lid.

Alternatively or additionally, the outer casing comprises a filling separation guide that extends along an edge of the filling opening, so that the filling opening can be created by separating along the filling separation guide. The filling separation guide is an area for a device by means of which the filling opening can be created. For example, the filling separation guide may be a perforation or tear-open strip.

It is beneficial if the packaging comprises a spacer that keeps the inner compartment at a distance from the base of the outer casing. In this case, the coolant compartment also extends underneath the inner compartment, which alone already constitutes a preferred embodiment of the invention. This results in a particularly strong cooling effect on the product.

The spacer is preferably made of at least one sheet and produced by folding it. The sheet is preferably constructed as described above.

It is beneficial if the lid features a window with a window cross-sectional area that corresponds to an inner compartment cross-sectional area, so that the inner compartment, in particular only the inner compartment, is visible through the window. This window may be made of transparent plastic, for instance. This plastic is preferably compostable; however, this is not essential.

Alternatively or additionally, the lid comprises a window separation guide that extends along an edge of the window cross-sectional area, so that the window can be created by separating along the window separation guide. The separation guide may again refer to a perforation or a tear-open strip, for example. It is then possible to create the window and remove the products from the packaging through the window cross-sectional area.

The feature that the window cross-sectional area corresponds to an inner compartment cross-sectional area should be understood particularly to mean that it is possible, but not essential, that the window cross-sectional area and the inner compartment cross sectional area are equal in the mathematical sense. In particular, it is possible for the two cross-sectional areas to deviate from one another, wherein a de-viation in size is preferably smaller than 5%. In practices one can correct this value if necessary.

According to a preferred embodiment, at least one of the walls has at least one viewing window, in particular made of transparent plastic, which allows a view of the coolant compartment. Preferably, at least two of the walls feature at least one viewing window each.

According to a preferred embodiment, the packaging comprises a handle, thereby al-lowing the packaging to be carried using the handle. This handle can be made, for example, of a strip of cellulose product and/or plastic, in particular compostable plastic.

The lid preferably features an insulation compartment. This may comprise, for example, a cavity filled with air.

In a container according to the invention, the coolant compartment preferably extends to a coolant compartment height that is at least half, preferably at least 0.8-times, a product height of the product. Here, it is to be understood that, when the packaging is standing on its base, each horizontal plane that extends through the product in the lower 80% of the product height also extends through the coolant compartment and thus through the ice when it is in use. It is especially beneficial if the coolant compartment height corresponds to at least the product height. The greater the coolant compartment height relative to the product height, the greater the cooling effect.

According to a preferred embodiment, a packaging height of the packaging is 0.8 to 1.5-times, in particular at most 1.2-times, a product height of the product. If the packaging height is smaller than the product height, the product preferably protrudes through the lid.

According to a preferred embodiment, the coolant compartment contains ice. The interior is effectively cooled as a result. The coolant compartment is preferably at least half-filled with ice.

The product is preferably a bottle. It is favourable if the bottle is filled with a liquid that has a freezing point below the freezing point of water, in particular below −3° C. Ice in the coolant compartment then keeps the liquid cool without freezing it.

Figure 1A:
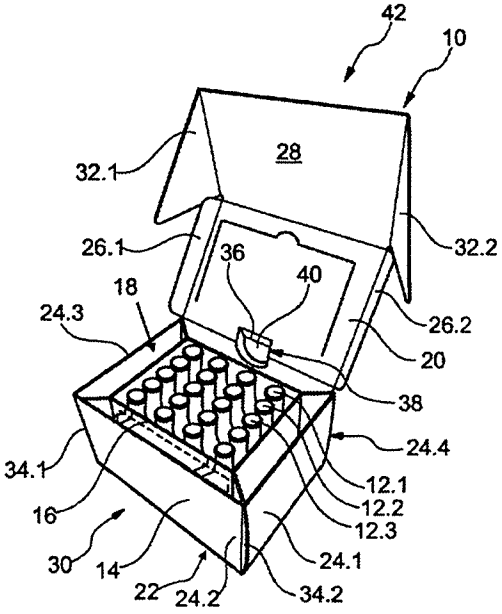
Figure 2B:
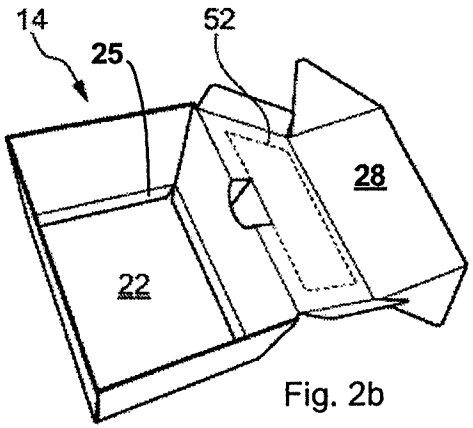
Figure 2C:
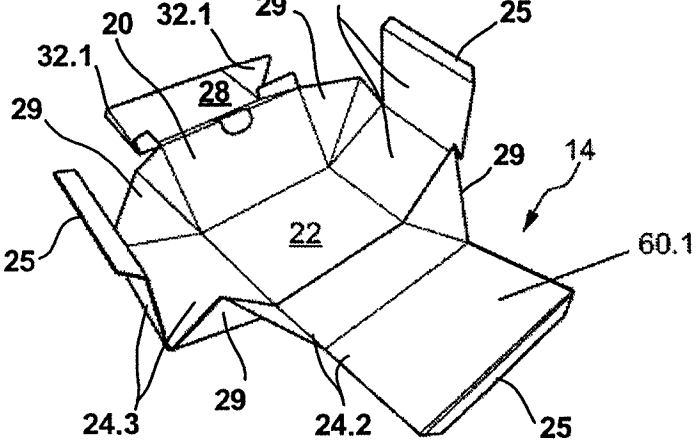
Figure 2A:
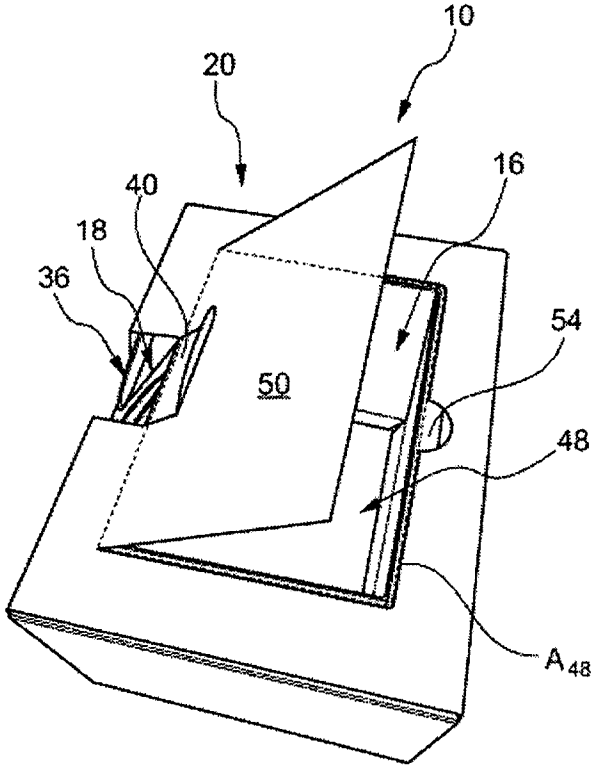
Figure 3B:
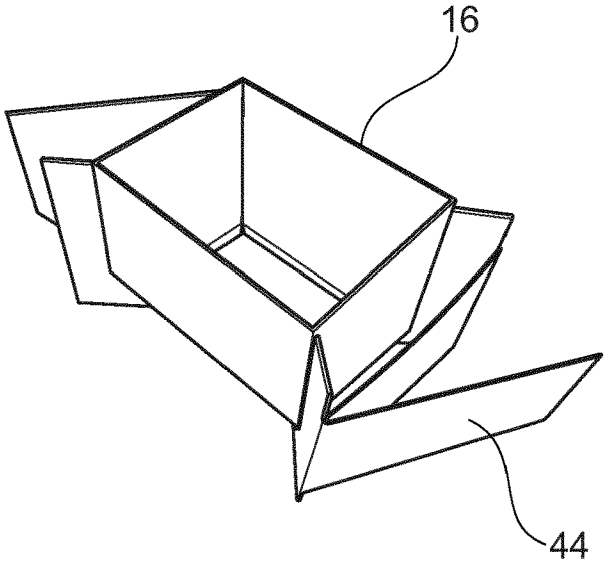
Figure 3C:
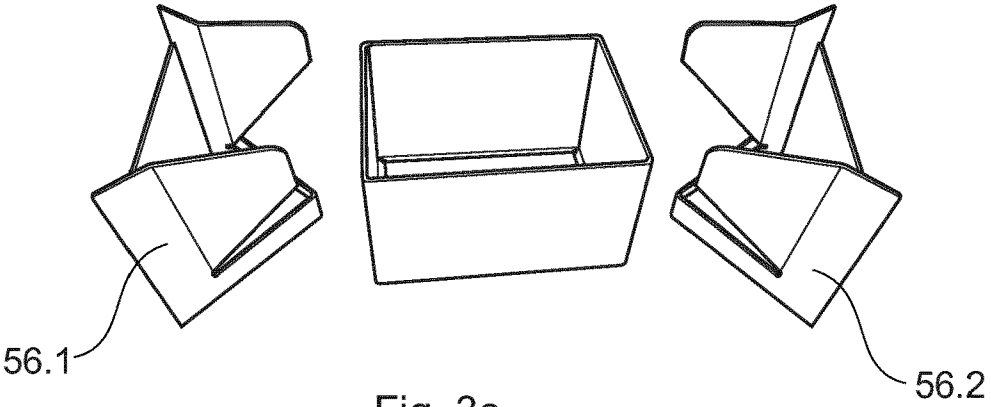
Figure 3A:
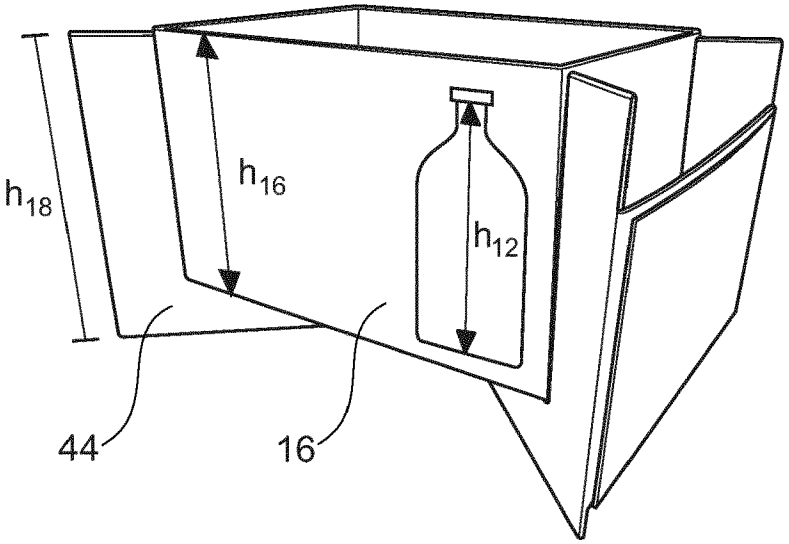
Figure 4B:
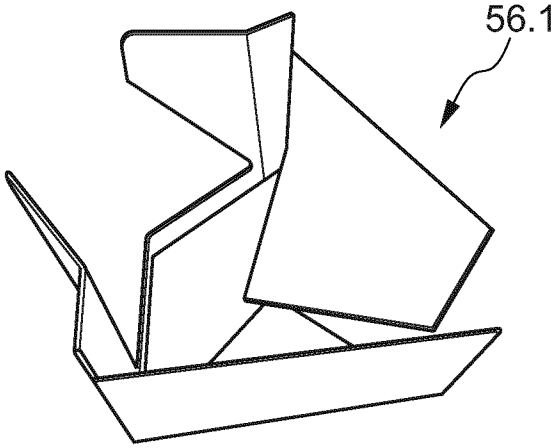
Figure 4C:
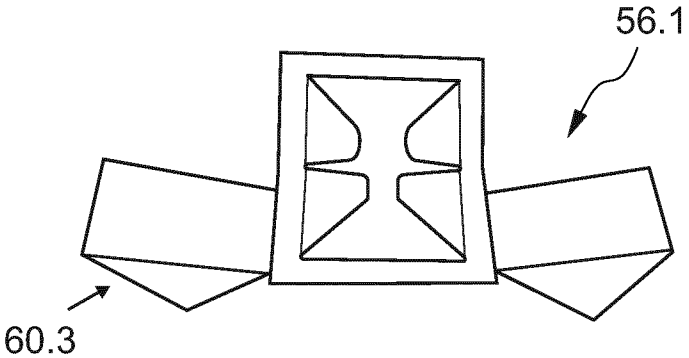
Figure 4A:
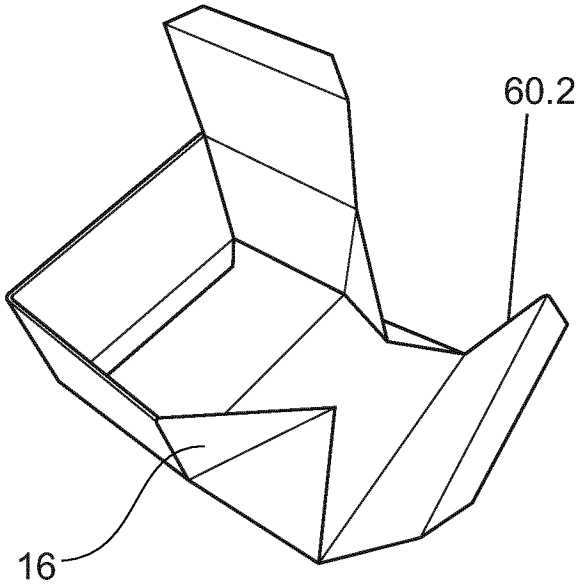
Figure 5B:
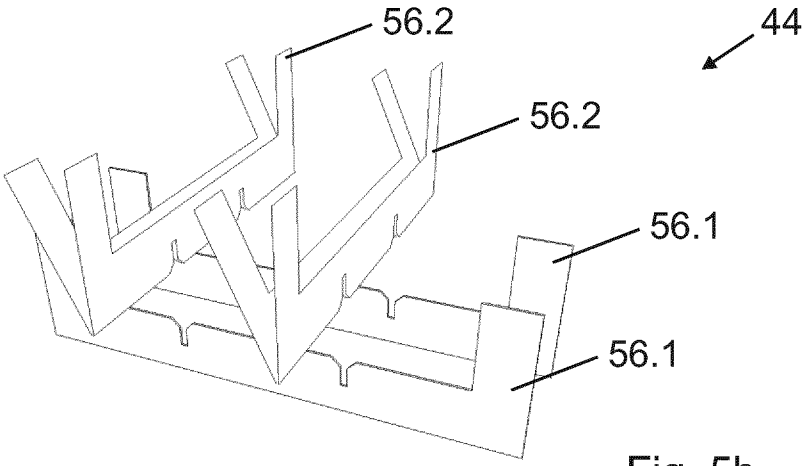
Figure 5C:
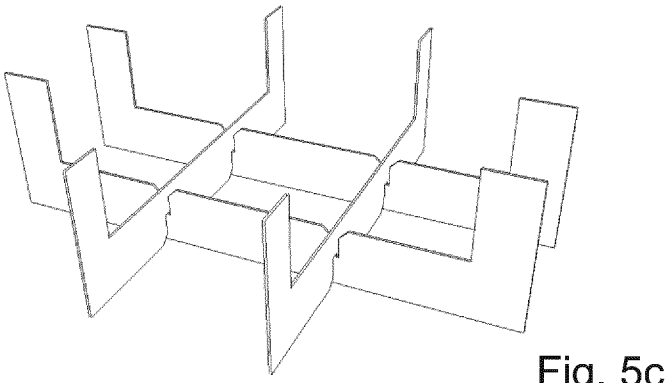
Figure 5A:
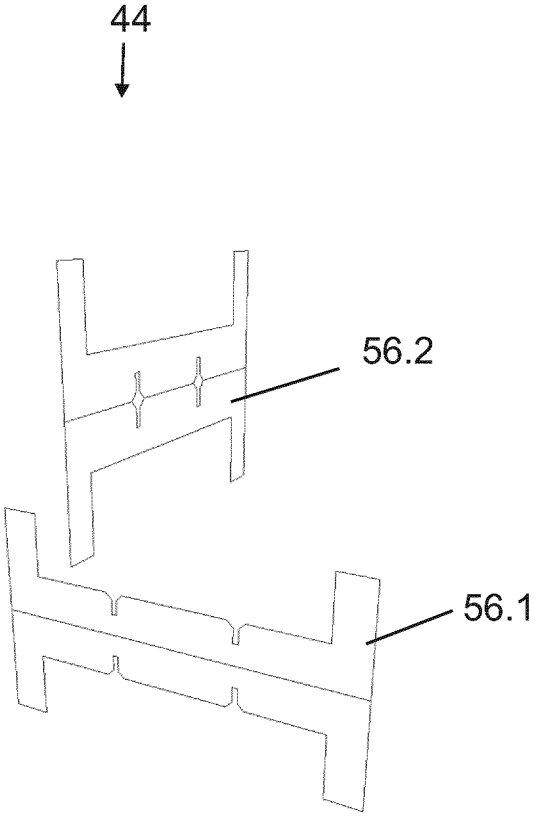
Figure 6B:
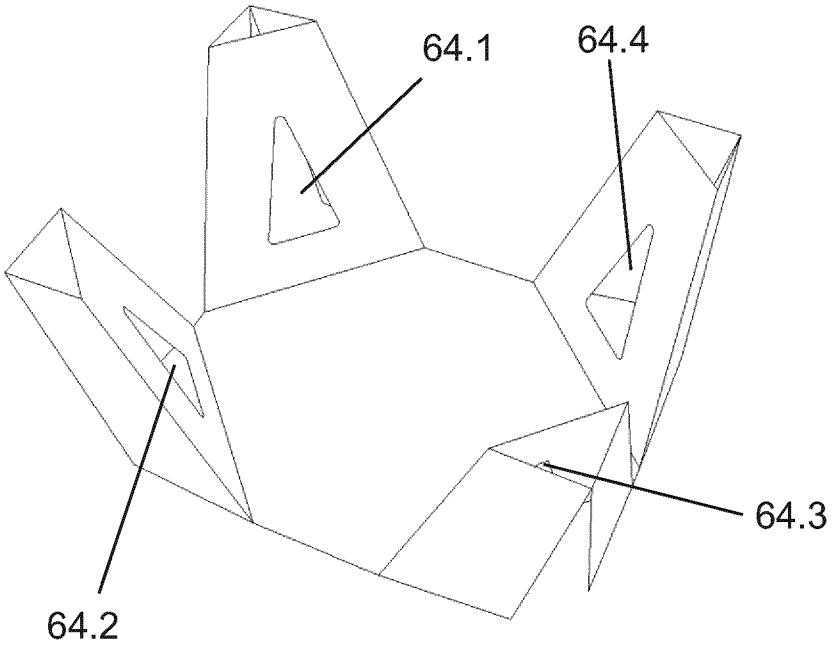
Figure 6A:
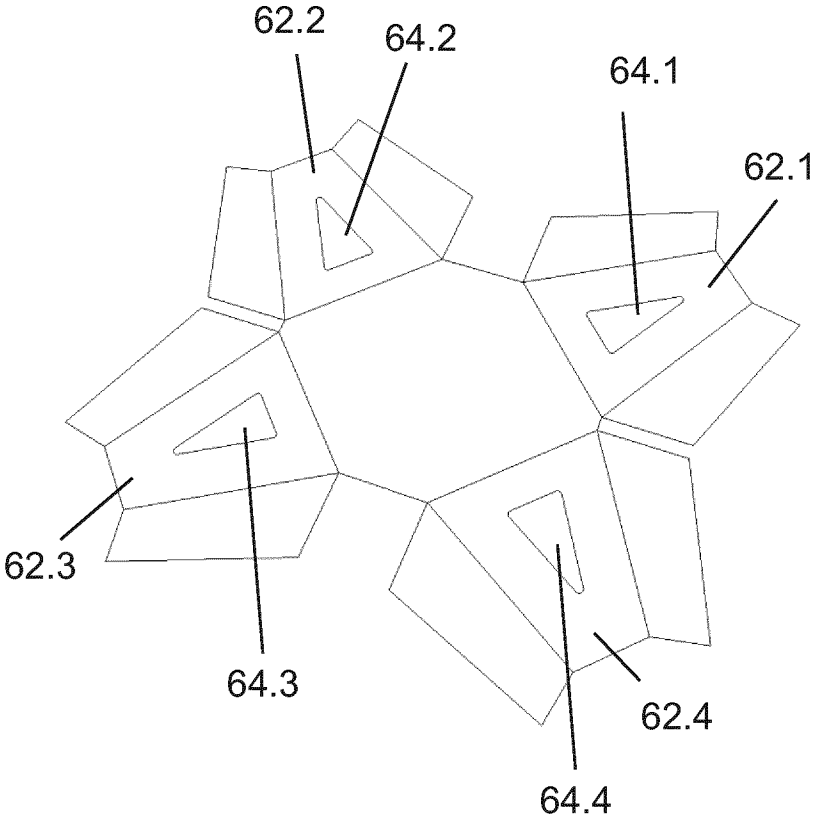
Figure 7C:
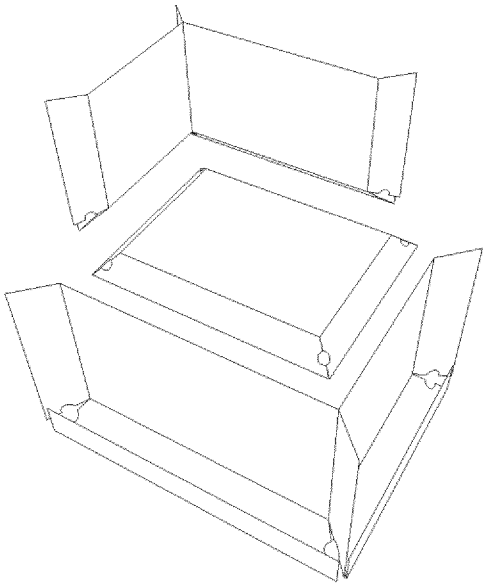
Figure 7A:
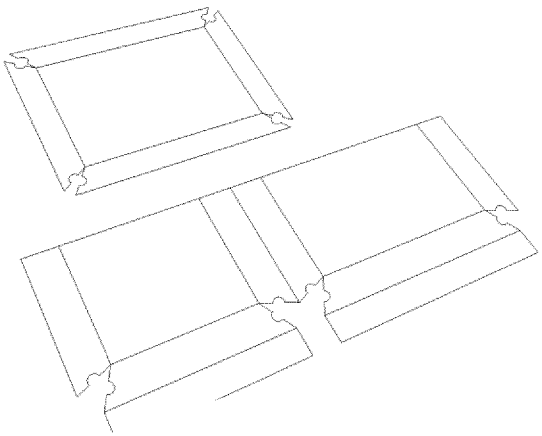
Figure 7B:
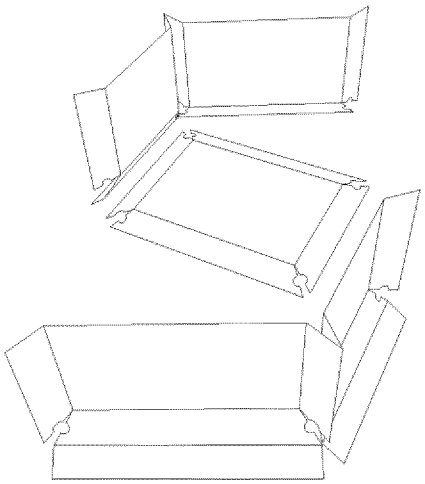

In the following, the invention will be explained in more detail by way of the attached figures. They show:

FIG. 1*a* a container according to the invention with the lid in its opening position, FIG. 1*b* packaging according to the invention in a three-dimensional view from the side, FIG. 2*a* a three-dimensional view of the packaging according to the invention with a closed lid, FIG. 2*b* the outer casing of the packaging according to FIG. 1*b*, FIG. 2*c* the outer casing in the unfolded state, FIG. 3*a* the inner compartment and the spacer of the packaging according to FIG. 1*b*, FIG. 3*b* the inner compartment and the spacer that is partially unfolded, FIG. 3*c* the inner compartment and the spacer, which is made of two supporting elements, FIG. 4*a* the inner compartment in the partially unfolded state, FIG. 4*b* a spacer element according to FIG. 3*c* in the partially unfolded state, and FIG. 4*c* the spacer element according to FIG. 4*b* in the fully unfolded state. The FIGS. 5*a*, 5*b*, 5*c* show an alternative spacer element for packaging according to the invention, the FIGS. 6*a*, 6*b* show a further alternative spacer element for packaging according to the invention, and the FIGS. 7*a*, 7*b*, 7*c* show another alternative spacer element for packaging according to the invention.

FIG. 1*a* depicts packaging 10 for the cooled storage of products 12.1 (i=1, 2 . . . ). In the present case, the products 12.*i* refer to small drinks bottles, but this is just an example; other products are possible. For example, the products may be cosmetic products, toiletries, medicines, food products or other products.

The packaging 10 has an outer casing 14, an inner compartment 16 and a coolant compartment 18.

The outer casing 14 comprises a lid 20, a base 22 and walls 24.1, 24.2, 24.3, 24.4 that extend between the base 22 and the lid 20. The coolant compartment 18 is the volume between the inner compartment 16 on the one side, and the walls 24 and the base 22 on the other. The coolant compartment 18 is confined upwards by the lid 20 when the lid is closed. In the FIG. 1*a*, the lid 20 is shown in its opening position.

The lid 20 comprises two optional side tabs 26.1, 26.2 for placing on the inside of the side walls 24.1, 24.3. The lid 20 also has a front section 28 which, when the lid 20 is in its closed position, extends along a front face 30 of the packaging 10 and therefore along the wall 24.2. The lid 20 can be fixed in its closed position by means of two fixing tabs 32.1, 32.2 that engage in slits 34.1, 34.2 in the side walls 24.1, 24.3.

According to an alternative embodiment, the front section is folded back in such a way that a double-walled lid is created. The double-walled lid has an insulation compartment filled with air, so that the lid has a particularly strong insulation effect.

The outer casing 14 features a filling opening 36 (cf. FIG. 2*a*) through which the coolant compartment 18 can be filled with water through the lid 20. In the present case, the filling opening 36 has been created by splitting the lid along a filling separation guide 38 in the form of a perforation, so that a cover tab 40 has been exposed.

The filling opening 36 is exposed by folding back the cover tab 40.

The entirety of the packaging 10 and the products 12.*i* form a container 42.

FIG. 1*b* depicts the packaging 10 without products 12.*i*. It can be seen that the packaging 10 comprises a spacer 44, by means of which the inner compartment 16 is kept at a predefined distance from the outer casing 14. As can be seen in FIG. 3*c* below, the spacer 44 supports the inner compartment 16 in such a way that an inner compartment base 46 is spaced apart from the base 22 of the outer casing 14. If the water is poured through the filling opening 36 into the coolant compartment 18, this water surrounds the inner compartment 16 on five sides.

In the present case, the packaging 10 is made of cardboard that is laminated on both sides. The lamination renders the cardboard waterproof. This should be understood to mean that, when the coolant compartment 18 is filled with water, after three days no more than one percent of the water can escape by any means other than evapo-ration.

FIG. 2*a* depicts a three-dimensional view of the packaging 10 with the lid 20 in its closed position. It is intended for the lid 20 to have a window 48 that allows a view from the outside of the inner compartment 16 and the products contained within it.

The window 48 has a window cross-sectional area $A_{48}$. A casement 50 is formed by separating the lid 20 along a window separation guide 52 (cf. FIG. 2*b*) which runs along an edge of the window cross-sectional area $A_{48}$. An operation aid 54 in the form of a punched-out tab renders it possible to grasp with a finger under the resulting casement 50 and thereby separate the lid 20 along the window separation guide 52 to create the casement 50.

In accordance with the alternative embodiment described above, if the front section is folded back to form a double-walled lid, the window 48 can pass through both layers of the double-walled lid. In this case, each layer has a casement.

FIG. 2*a* shows that the lid 20 forms a frame after opening the window 48, said frame covering the coolant compartment 18 (cf. FIG. 1*b*). Once the window 48 has been opened, the coolant compartment 18 is therefore not visible. However, this is an optional configuration.

FIG. 2*b* shows a perspective view of the outer casing 14. FIG. 2*c* depicts the outer casing 14 in the unfolded state. It can be seen that the outer imer casing 14 is made of one sheet 60.1 and produced by folding said sheet. Referring to FIG. 2*c*, it is seen that crease lines extend across the sheet 60.1, laterally along the respective bases of walls 24.1, 24.2, and 24.3 (collectively "walls 24") extending from the outer casing base 22. A similar lateral crease line extends across the base end of the lid 20. As also visible, each wall 24 has two additional lateral crease lines, each parallel to the lateral crease line at the walls 24 base. As visible in FIG. 2*c*, the second or middle of wall 24 lateral crease lines approximately bifurcates the distance from the wall 24 base crease line to their outermost lateral crease line. Viewing FIGS. 2*c* and 1 *b*, the distance of the wall 24 first or base lateral crease line to its second lateral crease line can be approximately one half the complete wall height.

As visible FIG. 2*c*, an end portion 25 of the walls 24 extends beyond the third lateral crease line. As visible in FIGS. 2*b* and 2*c*, the wall 24 end portion 25 extending from the third crease line is foldable to a configuration attachable to the base 22.

As seen in FIG. 2*b*, the one sheet 60.1 includes four regions configured as continuous corner sheets 29. As visible, two of the continuous corner sheets 29 span, in a rotational distance manner, from a lateral portion of one of the walls 24 to a lateral portion of another of the walls 24. Another two of the four continuous corner sheets 29 span from a lateral portion of one of the walls 24 and one lateral portion of the lid 24. As visible in FIG. 2*c*, the one sheet 60.1 includes, for each portion forming a continuous corner sheet 29, a radially bifurcating, i.e., center crease line. As understood from FIGS. 2*b* and 2*c*, raising walls 24 and the lid 24 toward vertical alignment with the base 22 rotates the walls 24 and the lid 20 about their first base or lateral crease line. It is seen from FIG. 2*c* that this movement of the walls 24 and lid 20 in-ward folds of the continuous corner sheets 29. As visible in FIGS. 2*a*-2*c*, the folding configuration can form the outer casing 14 by continuous sheet, without wall edge to wall edge spaces.

FIG. 3*a* shows a perspective view of the inner compartment 16 and the spacer 44.

FIG. 3*b* shows a perspective view of the inner compartment 16 and the spacer 44 in a partially unfolded state.

FIG. 3*c* shows that the spacer 44 is composed of two spacer elements 56.1, 56.2, each of which is made of a sheet.

FIG. 4*a* depicts the inner compartment 16 in a partially unfolded state. It can be seen that the inner compartment 16 is made from a single sheet of, in this case, dou-ble-sided laminated cardboard and is produced by folding it.

FIG. 4*b* depicts a spacer element 56.1 in a partially unfolded state. Both spacer elements 56.1, 56.2 are of the same design.

FIG. 4*c* depicts a spacer element 56.1 in a partially folded state.

FIG. 3*a* shows a coolant compartment height $h_{18}$, which in the present case corresponds to a packaging height of 0.8 to 1.2 times the product height of the product, except for a carton thickness.

In FIG. 1*b*, it can be seen that one of the walls, namely wall 24.3 here, features a viewing window 58 that enables a view into the coolant compartment 18. If the coolant compartment 18 is filled with frozen water, it is possible to see through the viewing window 58.

FIG. 2*c* shows that the outer casing 14 is made from a single first sheet 60.1 of cardboard laminated with plastic film. FIG. 4*a* shows that the inner compartment 16 is made from a single second sheet 60.2 of cardboard laminated with plastic film. FIG. 4*c* shows that the spacer element 56.1 is made from a single third sheet 60.3 of cardboard laminated with plastic film. In the present case, the spacer elements 56.1, 56.2 are each made of a sheet 60.3, 60.4. The sheets 60.*i* (i=1, . . . , 4) have been separated from a larger sheet, for example punched or cut out, creased if necessary and then folded. The sheets 60.*i* form a set of sheets according to the invention.

FIG. 5*a* depicts a second embodiment of a spacer 44 comprising two types of spacer elements 56.1, 56.2.

FIGS. 5*b* and 5*c* show how the two types of spacer elements 56.1, 56.2 are folded and the spacer 44 is made from two spacer elements of each type.

FIG. 6*a* shows a third embodiment of a spacer 44, which has four support tabs 62.*j* (j=1, . . . , 4). Each of the support tabs 62.*j* features one recess 64.*j*.

In FIG. 6*b*, the spacer 44 is shown in the folded state. The inner compartment 16 sits on the lower edges of the support tabs 62.*j*.

Another alternative for the spacer 44 is depicted in FIGS. 7*a*, 7*b*, 7*c*.

REFERENCE LIST

10 packaging
12 product
14 outer casing
16 inner compartment
18 coolant compartment
20 lid
22 base
24 wall
26 side tab
28 front section
30 front face
32 fixing tab
34 slit
36 filling opening
38 filling separation guide
40 cover tab
42 container
44 spacer
46 inner compartment base
48 window
50 casement
52 window separation guide
54 operation aid
56 spacer element
58 viewing window
60 sheet
62 support tab
64 recess
$A_{48}$ window cross-sectional area
$h_{18}$ coolant compartment height
$h_{10}$ packaging height
$h_{16}$ inner compartment height
$h_{12}$ product height

The invention claimed is:

1. Packaging for the cooled storage of at least one product, comprising:

a first single sheet, arranged in a configuration comprising folds and forming an outer casing that comprises (i) a base, (ii) a wall extending upward to a packaging height above the base;

(iii) a lid, flexibly connected with the wall at the wall's packaging height, and extending from the wall to a lid edge, in a configuration enabling manually actuated movement of the lid, moving the lid edge in an arcuate path about a rotation axis aligned with the flexible connection to the wall with extending along the flexible connection, to and from a closing position and an opening position, (iv) at least two additional walls, each extending upward from the base to a respective upper edge at the packaging height above the base;

a second single sheet, arranged in another configuration, which comprises folds and forms an inner compartment within the outer casing, the inner compartment having least three sides and enclosing an interior volume for accommodating the at least one product, wherein the outer casing and the inner compartment form, in combination, a coolant compartment which (i) is separated from an interior of the inner compartment and surrounds the inner compartment on the at least three sides, (ii) is fillable with water and is water-tight, and (iii) when filled with water permits freezing of the water within the coolant compartment, wherein the first single sheet, or the second single sheet, or both, comprise a laminated cellulose product, wherein the laminated cellulose product comprises waterproof lamination which faces the coolant compartment, wherein the lid is further configured to perform, in the closing position, a confining of an upper portion of the coolant compartment, and in the open position, no confining of the upper portion of the coolant compartment.

2. The packaging according to claim 1 wherein the outer casing features a filling opening, arranged in the lid, and configured to receive a flow of water and to route the water entering the filling opening exclusively into the coolant compartment.

3. The packaging according to claim 1 further comprising a spacer made of at least one single third sheet of laminated cellulose product, wherein the spacer is arranged between the outer casing formed by the first single sheet and the inner compartment formed by the second single sheet, in a configuration maintaining the inner compartment at a distance from the base of the outer casing.

4. The packaging according to claim 1 wherein the inner compartment has a cross-sectional area, and the lid is further configured with a window having a cross-sectional area having a correspondence to the cross-sectional area of the inner compartment providing only the inner compartment to be visible through the window.

5. The packaging according to claim 1 further comprising a handle that is attached to the packaging and configured for carrying the packaging using the handle.

6. The packaging according to claim 1, wherein the configuration of the first single sheet further comprises the lid having a double wall configuration that encloses an insulation compartment.

7. The packaging according to claim 1 further comprising: a label and a web, configured to perform a connecting of the label to the outer casing while in the coolant compartment, wherein the web connecting comprises concurrently maintaining the label, in response to a liquid water filled state of the coolant compartment, at a spacing from an inner surface of the outer casing a spacing from an outer surface of the inner compartment, and in response to a freezing of the water in the coolant compartment, followed by a removing of the outer casing while the water is frozen, causing the label to maintain in the ice, by causing a tearing of the label in response to a removing of the outer casing.

8. A container, comprising:

a packaging according to claim 1, and at least one product accommodated in the inner compartment of the packaging, wherein the coolant compartment of the packaging extends to a coolant compartment height which is at least 0.8-times a product height of the at least one product.

9. The container according to claim 8, wherein the first single sheet is further configured to form the lid with a configuration that includes at least one through passage, and the at least one product extends through the at least one through passage and protrudes above the lid.

10. The container according to claim 8, further comprising ice in the coolant compartment.

11. The container according to claim 10, wherein the ice at least half-fills the coolant compartment.

12. A kit for making a packaging for the cooled storage of at least one product, comprising a first waterproof sheet formed to a first configuration, wherein the first configuration comprises a first arrangement of creases, cuts, and partial folds, that provides a physical ability to transform, via a sequence of folding actions, the first waterproof sheet from the first configuration to an outer casing that comprises (i) a base, (ii) a wall extending upward to a packaging height above the base;

(iii) a lid, flexibly connected with the wall at the wall's packaging height, and extending from the wall to a lid edge, in a configuration enabling manually actuated movement of the lid, moving the lid edge in an arcuate path about a rotation axis aligned with the flexible connection to the wall with extending along the flexible connection, to and from a closing position and an opening position, (iv) at least two additional walls, each extending upward from the base to a respective upper edge at the packaging height above the base;

a second waterproof sheet formed to a second configuration, comprising a second arrangement of creases, cuts, and partial folds, enabling through another sequence of folding actions, a transforming of the second waterproof sheet from the second configuration to an inner compartment within the outer casing, the inner compartment having least three sides and enclosing an interior volume for accommodating the at least one product, and at least a third sheet, formed to an at least third configuration, comprising a third arrangement of creases, cuts, and partial folds, enabling through still another sequence of folding actions, a transforming of the third sheet from the at least third configuration to a spacer made of laminated cellulose product and arranged between the outer casing and the inner compartment in a configuration maintaining the inner compartment at the distance from the base of the outer casing, wherein the outer casing and the inner compartment form, in combination, a coolant compartment which (i) is separated from an interior of the inner compartment and surrounds the inner compartment on the at least three sides, (ii) is fillable with water and is water-tight, and (iii) when filled with water permits freezing of the water within the coolant compartment, wherein the first single sheet, or the second single sheet, or both, comprise a laminated cellulose product, wherein the laminated cellulose product comprises waterproof lamination which faces the coolant compartment, wherein the lid is further configured to perform, in the closing position, a confining of an upper portion of the coolant compartment, and in the open position, no confining of the upper portion of the coolant compartment.

13. The packaging according to claim 1 wherein the lid of the outer casing includes a cover removably secured in the lid by an opening separation guide, which extends along an edge of a filling opening, in a configuration wherein the filling opening is formed by separating along the opening separation guide.

14. The packaging according to claim 1, wherein the lid further comprises a window separation guide that extends along an edge of a window cross-sectional area and enables a removing of a portion of the lid within the window separation guide from an exterior portion of the lid.

15. The packaging according to claim 1, wherein the lid comprises a laminated cellulose product.

16. Packaging for the cooled storage of at least one product, comprising:

a first single sheet, arranged in a configuration comprising folds and forming an outer casing that comprises (i) a base, (ii) a wall extending upward to a packaging height above the base;

(iii) a lid, flexibly connected with the wall at the wall's packaging height, extending from the wall to a lid edge, in a configuration enabling manually actuated movement of the lid, moving the lid edge in an arcuate path about a rotation axis aligned with the flexible connection to the wall with extending along the flexible connection, to and from a closing position and an opening position, (iv) at least three additional walls, each extending upward from the base to a respective upper edge at the packaging height above the base, and (v) the wall and at least three additional walls are connected with one another in a joint-free manner;

a second single sheet, arranged in another configuration, which comprises folds and forms an inner compartment within the outer casing, the inner compartment having least three sides and enclosing an interior volume for accommodating the at least one product, wherein the outer casing and the inner compartment form, in combination, a coolant compartment which (i) is separated from an interior of the inner compartment and surrounds the inner compartment on the at least three sides, (ii) is fillable with water and is water-tight, and (iii) when filled with water permits freezing of the water within the coolant compartment, wherein the first single sheet, or the second single sheet, or both, comprise a laminated cellulose product, wherein the laminated cellulose product comprises waterproof lamination which faces the coolant compartment, wherein the lid is further configured to perform, in the closing position, a confining of an upper portion of the coolant compartment, and in the open position, no confining of the upper portion of the coolant compartment.

17. The packaging of claim 16, wherein the inner compartment formed from the second single sheet comprises at least four sides including the at least three sides, and wherein the at least four sides are connected with one another in a joint-free manner.

18. The packaging of claim 16, wherein the first single sheet has folded-in noses which are held in place (i) by a flap of the first single sheet extending along a side wall or (ii) by the second single sheet or (iii) by a spacer arranged between the outer casing formed by the first single sheet and the inner compartment formed by the second single sheet in a configuration maintaining the inner compartment at a distance from the base of the outer casing.

* * * * *